US005573176A

United States Patent [19]

Applegate

[11] Patent Number: 5,573,176

[45] Date of Patent: Nov. 12, 1996

[54] MINIMAL SHIPPING CONTAINER AND METHOD OF CONSTRUCTION

[75] Inventor: Stephen S. Applegate, Milford, Ohio

[73] Assignee: The Procter & Gamble Company, Cincinnati, Ohio

[21] Appl. No.: 310,605

[22] Filed: Sep. 22, 1994

[51] Int. Cl.[6] ..... B65D 25/54

[52] U.S. Cl. ..... 229/162; 220/91

[58] Field of Search ..... 229/23 R, 162; 220/9.1, 401; 206/497

[56] References Cited

U.S. PATENT DOCUMENTS

| | | | |
|---|---|---|---|
| 1,108,289 | 8/1914 | Weiss . | |
| 1,253,067 | 1/1918 | McGahan . | |
| 1,693,023 | 9/1926 | Cleaves . | |
| 2,548,985 | 4/1951 | Lighter | 206/45.31 |
| 3,504,842 | 4/1970 | Grafslund | 229/23 |
| 3,517,849 | 6/1970 | Presnick | 220/4 |
| 3,805,473 | 4/1974 | Lidgard | 206/451 X |
| 3,833,116 | 9/1974 | Howe | 206/431 |
| 3,891,086 | 6/1975 | Isaacs | 206/497 |
| 4,811,840 | 3/1989 | Muyskens | 206/320 |
| 4,919,270 | 4/1990 | Govang et al. | 206/497 X |
| 4,982,872 | 1/1991 | Avery | 220/461 |
| 5,004,104 | 4/1991 | Saulas | 206/526 |
| 5,271,498 | 12/1993 | Gillespie | 206/497 |
| 5,277,310 | 1/1994 | Mertz | 206/320 |
| 5,289,969 | 3/1994 | Schwaner | 229/23 R |
| 5,307,928 | 5/1994 | Bishop | 206/320 |
| 5,398,869 | 3/1995 | Dickson et al. | 229/162 |

FOREIGN PATENT DOCUMENTS

| | | |
|---|---|---|
| 9101392 | 1/1993 | Netherlands . |
| 1443824 | 7/1976 | United Kingdom . |

OTHER PUBLICATIONS

Advertisement for Moen Industries "Wrap and Cap H–Bliss Display" dated Jul. 25, 1994–Exhibit #1.

*Primary Examiner*—Gary E. Elkins
*Assistant Examiner*—Christopher J. McDonald
*Attorney, Agent, or Firm*—Ronald W. Kock

[57] ABSTRACT

A Minimal Container, made of pre-cut corrugated cardboard strips fastened together at overlapping surfaces and folded to form a rectangular frame, without generating any scrap corrugated cardboard. The Minimal Container is intended to protect contents for one shipping application. Each side and top and bottom ends of the rectangular frame have an open area. Plastic film is wrapped around the Minimal Container, enclosing it and being connected to it, not only for dust and weather protection, but also to enhance structural rigidity of the Minimal Container. A method of constructing the Minimal Container includes gluing or stapling the corrugated cardboard strips together to form a ladder structure; scoring, slitting, and folding the ladder structure to form the rectangular frame; fastening the rectangular frame together; loading contents in to the rectangular frame; enclosing the rectangular frame with a flexible plastic film wrap; and connecting the flexible plastic film wrap to the rectangular frame.

7 Claims, 1 Drawing Sheet

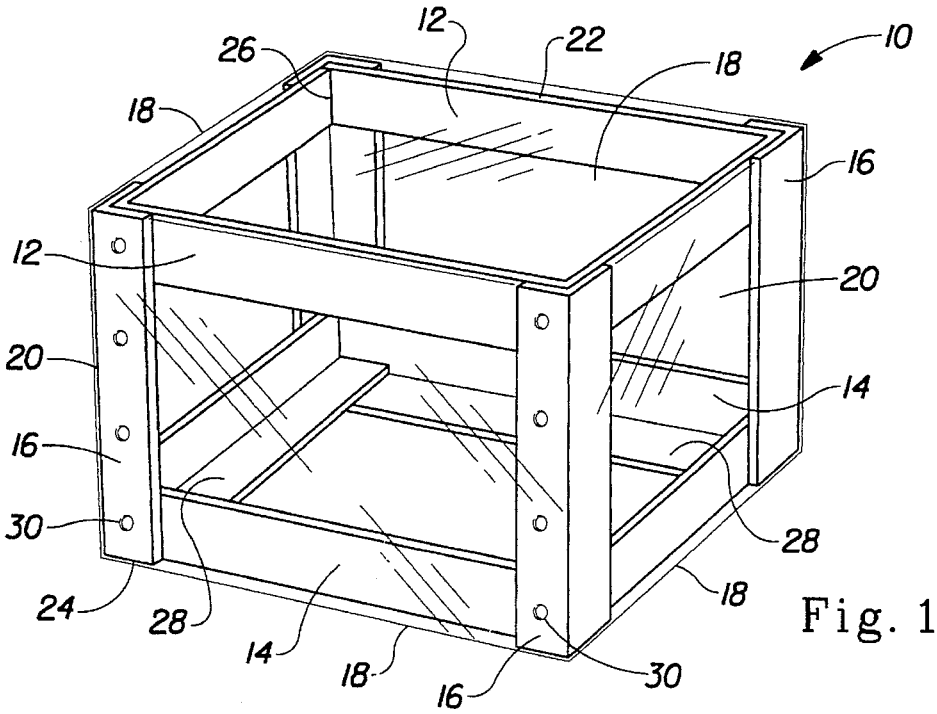
Fig. 1
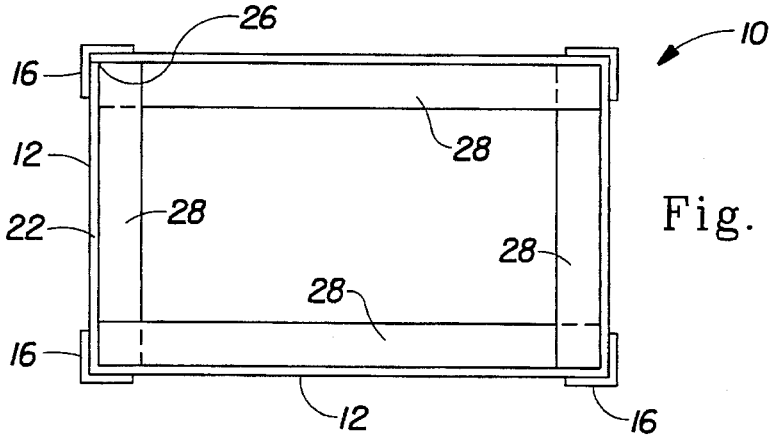
Fig. 2
Fig. 3
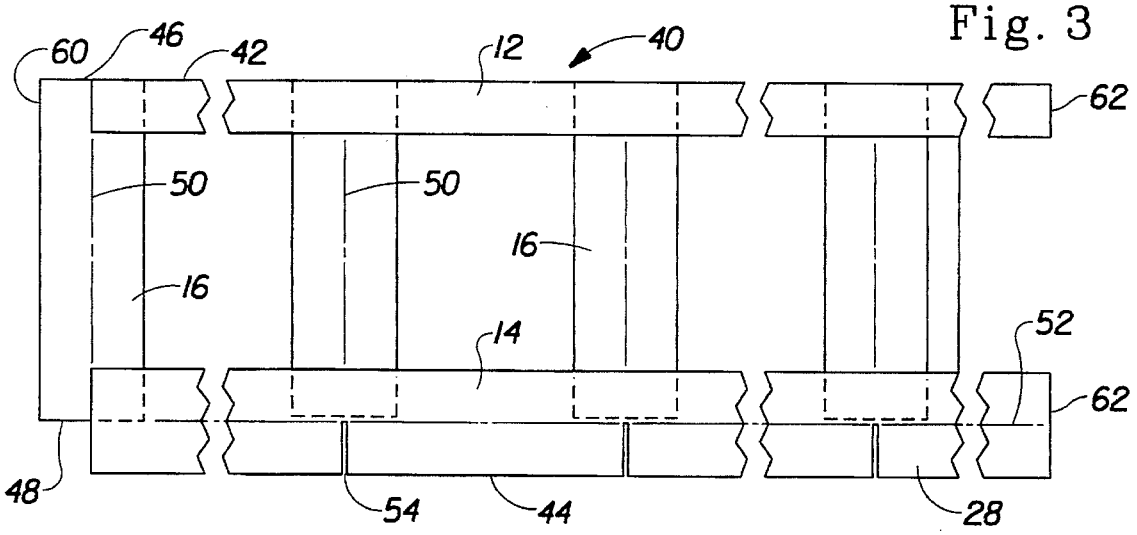

MINIMAL SHIPPING CONTAINER AND METHOD OF CONSTRUCTION

FIELD OF THE INVENTION

The present invention relates to corrugated cardboard shipping containers, and more particularly to such containers wherein top, bottom and sides have large openings to reduce material usage and container weight. Even more particularly, the present invention relates to such containers which are constructed by fastening together pre-cut corrugated cardboard strips.

BACKGROUND OF THE INVENTION

Corrugated cardboard containers are commonly used for storing and shipping consumer durable and non-durable goods from manufacturer to retailer. During storage and shipping, such containers are stacked upon each other on pallets or in unit loads. Stacks are at least the height of trucks or rail cars, and may reach 30 feet or so in warehouses. Therefore, shipping containers not only protect their contents from dust and weather, but also they typically provide column strength to protect their contents from the weight of other containers stacked above them.

The corrugated/laminated material of shipping containers provides rigidity and column strength while being light in weight and low in cost. Typically, fiat container blanks are die cut from large sheets of corrugated cardboard, scored for folding, and formed into rectangular containers with flaps, using glue or staples to secure walls of the container at fight angles to each other. These containers are commonly called Regular Slotted Containers.

Historically, further reducing the weight of corrugated cardboard containers has not been important because they are already light weight. However, environmental pressures for source reduction, reduced packaging, and material recycling, have caused corrugated cardboard containers to be reexamined. One environmentally favorable approach has been to reuse each container several times. Such containers are commonly called Reshipper Containers. Reshipper Containers are robustly constructed to absorb the abuses of loading, unloading, and multiple shipping and storage situations.

More recently, containers have been made with large die-cut openings. Instead of reuse, these containers are intended for a single use, but they have less material than Regular Slotted Containers. Some such containers are constructed from multiple, odd-shaped corrugated pieces for specialized applications, such as heavy appliance shipping. They may have wooden supports or metal frames to increase structural rigidity. The large open sides may be wrapped with plastic film to protect container contents from dust and weather. The specialized nature of such containers, combined with their hand assembly and high scrap cost from die cutting corrugated shapes, does not provide a low cost alternative for shipping most consumer goods, however.

Other die-cut, single-use containers are essentially Regular Slotted Containers with portions of side panels removed by further die-cutting. Any material that is die-cut from a carton blank becomes scrap. Although such scrap may be recycled, handling and recycling scrap have significant costs associated with them. What is needed is a minimal material container which is formed without the generation of scrap.

SUMMARY OF THE INVENTION

The present invention provides a Minimal Container made of pre-cut corrugated cardboard strips which are fastened together to form a light weight rectangular frame container intended for single use. Plastic film is wrapped around and connected to the rectangular frame, not only for dust and weather protection, but also to enhance structural rigidity. The Minimal Container's overall reduction of 50 % to 80% of container material, compared to Regular Slotted Containers, benefits the environment via source reduction. More importantly, shipping weight reduction and material cost savings are realized by the Minimal Container. By being constructed of pre-cut strips instead of die-cut blanks, there is no scrap associated with the Minimal Container. Also, because the overlapping joints of the pre-cut strips occur at the corners of the Minimal Container, its corners have enhanced strength to support container stacking.

In one preferred aspect of the Minimal Container a Minimal Container for shipping consumer disposable goods comprises a rectangular frame of corrugated cardboard having four sides, a top end and a bottom end. Each of the four sides, the top end, and the bottom end have an open area. The rectangular frame is made of interfitting strips fastened together such that there is no cardboard scrap generated. A flexible film is wrapped around and encloses the four sides, the top end, and the bottom end of rectangular frame after contents have been placed in it. The flexible film wrap is connected to the rectangular frame so that the frame is stiffened and the contents are protected.

Preferably, the interfitting strips have face-to-face contact fastening, so that when fastened together, the interfitting strips form a substantially fiat ladder-shaped structure having two ends. The ladder-shaped structure is pre-scored and slit to facilitate the folding thereof. The rectangular frame is formed by folding end-to-end the substantially fiat ladder-shaped structure, and then fastening together the two ends of the ladder-shaped structure. The flexible film is preferably either shrink-wrapped around the rectangular frame so that the connection to the rectangular frame is via friction, or the flexible film is wrapped around the rectangular frame and intermittently heat bonded thereto.

In another preferred aspect of the Minimal Container a ladder-shaped structure for forming a Minimal Container has a perimeter, a height, and four side corners. The ladder-shaped structure comprises two longitudinal corrugated cardboard strips positioned substantially parallel to each other, and four lateral corrugated cardboard strips having outer ends and lengthwise centerlines. The two longitudinal strips have outermost edges and lengths at least as great as the perimeter of the Minimal Container. The two longitudinal strips are positioned such that the outermost edges are spaced apart a distance at least as great as the height of the Minimal Container. The four lateral strips have lengths at least as short as the height of the Minimal Container. The four lateral strips are laid substantially perpendicular to the two longitudinal strips with the outer ends being placed between the outermost edges of the longitudinal strips. The four lateral strips are spaced apart to form a ladder-shaped structure. The lengthwise centerlines of the four lateral strips correspond to the four side comers of the Minimal Container when the ladder-shaped structure is folded at the lengthwise centerlines. The four lateral strips are fastened to the two longitudinal strips wherever overlap occurs between them. Preferably, the four lateral strips are scored for folding along the lengthwise centerlines.

More preferably, the ladder-shaped structure includes a top longitudinal strip having a first outermost edge and a bottom longitudinal strip having a second outermost edge, where the first and second outermost edges are spaced apart a distance greater than the length of each of the four lateral strips. Each of the four lateral strips have first and second outer ends, and the first outer ends are positioned along the first outermost edge of the top strip. The bottom longitudinal strip is slit, from the second outermost edge to the second outer ends of the four lateral strips, in line with the lengthwise centerlines of the four lateral strips. When the ladder-shaped structure is folded at the lengthwise centerlines, the bottom longitudinal strip has a portion extending below the second outer ends which is folded at about 90° perpendicular to the four lateral strips to form bottom flanges of the Minimal Container. The bottom flanges have an overlap near the four side corners of the Minimal Container and are fastened together at the overlap.

In still another preferred aspect of the Minimal Container, a method of constructing a Minimal Container for shipping consumer disposable goods comprises the steps of pre-cutting strips of corrugated cardboard and arranging them with face-to-face overlapping surfaces; fastening the strips of corrugated cardboard together at the overlapping surfaces to form a ladder-shaped structure having two ends; scoring the ladder-shaped structure for folding; folding the ladder-shaped structure and fastening together the structure at the two ends to form a rectangular frame; placing contents to be shipped in the rectangular frame; wrapping and enclosing the rectangular frame with a flexible plastic film; and connecting the flexible plastic film to the rectangular frame so that the rectangular frame is stiffened and the contents are protected. Preferably, the strips of corrugated cardboard are fastened together either by hot melt adhesive or by staples.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

FIG. 1 is a perspective view of a preferred embodiment of the Minimal container of the present invention, disclosing its rectangular frame construction wrapped with a flexible plastic film;

FIG. 2 is a top plan view thereof, but without the film wrap, showing the manner in which sides and bottom corrugated members are connected; and FIG. 3 is a front elevation view of a Minimal container before it has been formed into a rectangular frame, disclosing the ladder-shaped structure of the interconnected corrugated cardboard strips.

DETAILED DESCRIPTION OF THE INVENTION

Referring now to the drawings, and more particularly to FIG. 1, there is shown a first preferred embodiment of a Minimal Container, which is generally indicated as 10. Minimal Container 10 is a three-dimensional framework which has top strip 12, bottom strip 14, corner strips 16, and transparent plastic film wrap 18. Container 10 is preferably rectangular with four sides 20 and a top end 22 and bottom end 24. All sides and top and bottom preferably have large open areas to minimize container weight. Plastic film 18 is wrapped externally around all four sides 20 and top end 22 and bottom end 24, and connected to corner strips 16 to enhance the rigidity of Container 10 as well as to protect the contents of the container.

Alternatively, Container 10 may have fewer or more comers and be other than rectangular in shape. Additional strips may be added as needed. However, all strips are preferably pre-cut such that no scrap is generated in the formation of the Minimal Container 10.

Top strip 12 and bottom strip 14 are longitudinal strips extending about the perimeter of Container 10, and they are preferably made of corrugated cardboard with the corrugations running perpendicular to the length of the strips. Top and bottom strips 12 and 14 each have ends which preferably abut in the same corner, such as at a corner 26. Corner strips 16 are preferably folded lateral strips which overlap top and bottom strips 12 and 14 and are fastened to the longitudinal strips by adhesive, staples, or other common means for attaching flat face-to-face surfaces together. Corner strips 16 are preferably made of corrugated cardboard which have their corrugations running parallel to their lengths. Therefore, the corrugations of all pieces preferably run vertically in Container 10, as shown in FIG. 1, in order to maximize the strength of Container 10 to stacking loads placed against top end 22. Comer strips 16 are preferably equal width strips folded as angles about lengthwise axes at their centers. Comer strips 16 are preferably positioned outside top and bottom strips 12 and 14 so that the connections of top and bottom pieces 12 and 14 at corner 26 are made inside the corner strips. The connections made inside the corners do not detract from the outer appearance of Container 10, and the outer corner strips do not reduce the volume inside the top and bottom strips, which preferably tightly enclose the contents of the container.

FIGS. 1 and 2 show bottom strip 14 having a flange 28 folded inward. Such a flange is preferred because it significantly increases the structural rigidity of Container 10. The ends of flange 28 overlap and are fastened together. Top strip 12 may also have such a flange, but none is shown in FIGS. 1.

Plastic film 18 improves the rigidity of Container 10 when it is connected to the cardboard strips. Preferably the connection is by spot heat sealing, such as to corner strips 16 at spots 30. However, a shrink-wrapped film or the like may have sufficient connection due to friction alone. Staples may also be used.

Minimal Container 10 may be formed by fastening pre-cut strips together in a three-dimensional framework; however, it is preferably constructed from a substantially flat structure which may either be folded, fastened and then loaded with contents; or which may be folded around contents and then fastened together. FIG. 2 shows an open container from the top end which is formed prior to loading the contents. FIG. 3 shows a substantially flat assembly of two pre-cut longitudinal strips 12 and 14, and four pre-cut lateral strips 16, all fastened together where they overlap to form a ladder-shaped structure 40. Ladder-shaped structure 40 may be folded around container contents and then fastened or it may be folded to form the empty container of FIG. 2.

Ladder-shaped structure 40 of FIG. 3 has a bottom strip 14 with flange 28. Top strip 12 has no flange. The longitudinal strips 12 and 14 have outermost edges 42 and 44, respectively. Lateral strips 16 have outer ends 46 and 48 and lengthwise centerlines 50. Lateral strips 16 are placed against longitudinal strips 12 and 14 with their outer ends 46 substantially even with outermost edge 42. Outer ends 48, however are placed substantially even with a centerline 52 which runs the length of bottom strip 14. Flange 28 extends beyond outer ends 46 on the other side of centerline 52.

Within flange 28 are cut slits 54 from outer edge 44 into centerline 52 to enable flange 28 to be folded perpendicular to strips 12 and 14 when ladder-shaped structure 40 is folded into a three-dimensional rectangular frame. Slits 54 are perpendicular to outermost edge 44 and they are located along centerlines 50.

In order to more easily fold ladder-shaped structure 40 into a three-dimensional rectangular frame, ladder-shaped structure 40 is preferably scored along centerlines 50 such that centerlines 50 become the corners of the Container 10. When ladder-shaped structure 40 is folded, the height of Container 10 is preferably defined by the length of lateral strips 16, and the length and width of Container 10 are defined by the spacing between centerlines 50. The lengths of longitudinal strips 12 and 14 are such that they abut to complete the inner perimeter of Container 10, as shown in FIG. 1.

Ladder-shaped structure 40 has two opposite ends 60 and 62. End 60 has longitudinal strips 12 and 14 overlapped by only half of lateral strip 16. The rest of lateral strip 16 extends beyond the ends of strips 12 and 14. End 62 has only the opposite ends of longitudinal strips 12 and 14. When Container 10 is folded, end 62 may be fastened to the extended half of lateral strip 16 to form a complete rectangle with the ends of longitudinal strips 12 and 14 abutting.

Alternatively, strips 12 and 14 may be slightly shorter than the full inner perimeter of Container 10. In this case they will not quite abut. However, lateral strip 16 may still be fastened to the ends of strips 12 and 14 to hold Container 10 together. If strips 12 and 14 are longer than the inner perimeter of Container 10, there would have to be some overlap of strips 12 and 14. This is undesirable because such overlap may prevent strips 12 and 14 from tightly wrapping against the contents of Container 10.

In a particularly preferred embodiment of the present invention, a Minimal Container has dimensions of 15.5 inches (393.7 mm) width, 20.25 inches (514.3 mm) length, and 9.75 inches (247.6 mm) height, and is made of 275 pound Kraft corrugated cardboard strips. All the strips are approximately 4 inches (101.6 mm) wide, except for top strip 12, which is 3 inches (76.2 mm) wide. The cardboard is available from Container Corp. of America, of Cincinnati, Ohio.

The pre-cut strips are glued together wherever they overlap in the ladder-shaped structure, and at bottom flange 28, when they are formed into a three-dimensional rectangular frame. The glue is preferably a standard hot melt adhesive used for case sealing, which is applied manually by a hot melt adhesive gun, such as a 3M Polygun TC hot melt applicator, made by 3M Corp. of St. Paul, Minn. Alternatively, an automated means for making cannon blanks of ladder-shaped structure 40 may be available using a slotter-folder-gluer machine, such as model no. ZLM, made by The Ward Company, of Cockeysville, Md. Such a machine would also slit and score the ladder-shaped structure while it is still in its flat form.

The ladder-shaped structure is preferably wrapped around contents, such as Pampers®, made by The Procter & Gamble Company of Cincinnati, Ohio. This may be done by a Wraparound Case Packing machine, made by The Douglas Co., of Alexandria, Minn. This machine also seals the ends 60 and 62 together and folds and seals the overlapping flanges 28 to complete the cardboard structure of Minimal Container 10.

Once the Minimal Container is formed and filled and fastened, it is wrapped with a 2 mil thick plastic film, for example polyethylene film, made by Bemis Co. of Terre Haute, Ind. This film is somewhat transparent. An automated means for wrapping plastic film 18 around the three-dimensional frame is a Hayssen Multiflow machine, model no.HC-40, made by Hayssen Co. of Sheboygan, Wis.

The plastic film wrap 18 is finally spot heat sealed to the cardboard corner strips 16 at spots 30 by using a heated die or hot melt adhesive, which melts through the film and bonds the edges of the resulting film hole to the cardboard. Spot seals are desired because the Minimal Container herein described is believed to gain a substantial increase in rigidity to twist compared to one without spot sealing.

The preferred Minimal Container is believed to provide nearly the same stacking strength as a Regular Slotted Container. The double wall corners compensate for the absence of solid side walls. However, the preferred Minimal Container weighs only about half the weight of the same size Regular Slotted Container.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A corrugated shipping container blank comprising a unitary and substantially flat ladder-shaped structure made of substantially rectangular-shaped interfitting strips of corrugated cardboard, said interfitting strips of corrugated cardboard being fastened together by a bonding means at overlapping areas of said strips to form substantially open areas in said ladder-shaped structure, said ladder-shaped structure having two ends, said ladder-shaped structure having fold lines so as to be foldable at said interfitting strips and connectable at said two ends to form a shipping container.

2. The corrugated shipping container blank of claim 1 wherein all of said interfitting strips of corrugated cardboard have corrugations oriented in substantially the same direction when said interfitting strips are fastened together.

3. A ladder-shaped structure for forming a rectangular shipping container, said ladder-shaped structure comprising:

a) two longitudinal strips of corrugated cardboard spaced apart and positioned substantially parallel, said two longitudinal strips having first and second outermost edges, first and second ends, and substantially equal lengths;

b) a first lateral strip of corrugated cardboard positioned substantially perpendicular to said longitudinal strips and overlapping said longitudinal strips such that both ends of said first lateral strip are located within said first and second outermost edges of said longitudinal strips;

c) a second lateral strip of corrugated cardboard positioned substantially perpendicular to said longitudinal strips and overlapping said longitudinal strips such that both ends of said second lateral strip are located within said first and second outermost edges of said longitudinal strips, said second lateral strip being spaced apart from said first lateral strip;

d) a third lateral strip of corrugated cardboard positioned substantially perpendicular to said longitudinal strips and overlapping said longitudinal strips such that both ends of said third lateral strip are located within said first and second outermost edges of said longitudinal strips, said third lateral strip being spaced apart from said second lateral strip;

e) a fourth lateral strip of corrugated cardboard positioned substantially perpendicular to said longitudinal strips and overlapping said longitudinal strips such that both ends of said fourth lateral strip are located within said first and second outermost edges of said longitudinal strips, said fourth lateral strip being spaced apart from said third lateral strip, said substantially equal lengths of said longitudinal strips being sufficiently long to fold said ladder-shaped structure at each of said first, second, third, and fourth lateral strips along axes substantially perpendicular to said two longitudinal strips to form a rectangular shipping container, and whereby said first and second ends of said longitudinal strips overlap; and f) a bonding means for fastening together each of said longitudinal and lateral strips wherever they overlap, said bonding means activated to form a flat unitary ladder-shaped structure prior to the folding thereof.

4. The ladder-shaped structure of claim 3 wherein said bonding means comprises adhesive.

5. The ladder-shaped structure of claim 3 wherein said bonding means comprises stapling.

6. The ladder-shaped structure of claim 3 wherein said first, second, third, and fourth lateral strips are fastened to one side of said two longitudinal strips and said ladder-shaped structure is folded such that said first, second, third, and fourth lateral strips are located outside said two longitudinal strips when said rectangular shipping container is formed.

7. The ladder-shaped structure of claim 3 wherein said two longitudinal strips of corrugated cardboard and said first, second, third, and fourth lateral strips of corrugated cardboard all have corrugations oriented in substantially the same direction when said longitudinal and lateral strips are fastened together.

* * * * *

UNITED STATES PATENT AND TRADEMARK OFFICE
Certificate

Patent No. 5,573,176 Patented: November 12, 1996

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Donald J. Avery, Chesterfield, Missouri.

Signed and Sealed this Fifth Day of November 2002.

LEE W. YOUNG
*Supervisory Patent Examiner*
Art Unit 3727